United States Patent [19]

Bunczk

[11] Patent Number: 4,976,184

[45] Date of Patent: Dec. 11, 1990

[54] AUTOMATIC PISTOL BARREL AND RECOIL COMPENSATOR

[76] Inventor: Joseph M. Bunczk, 248 Miami Ave., Norristown, Pa. 19403

[21] Appl. No.: 466,771

[22] Filed: Jan. 18, 1990

[51] Int. Cl.[5] ..... F41A 21/36

[52] U.S. Cl. ..... 89/14.3

[58] Field of Search ..... 89/14.3

[56] References Cited

U.S. PATENT DOCUMENTS

| | | | |
|---|---|---|---|
| 1,738,751 | 12/1929 | Bluehdorn | 89/14.3 |
| 2,935,000 | 5/1960 | Mowrey | 89/14.3 |
| 4,207,799 | 6/1980 | Tocco | 89/14.3 |

*Primary Examiner*—Stephen C. Bentley
*Attorney, Agent, or Firm*—John Lezdey

[57] ABSTRACT

A barrel and recoil compensator for a slide-type automatic pistol comprising a tubular cylindrical body member having an internal bore for forming a gun barrel and an axially movable slide chamber assembly surrounding the cylindrical body member said cylindrical body member having at one end portion for detachably securing the cylindrical body to said pistol, an opposite end portion and a shoulder portion therebetween the shoulder portion forming a first stop for the slide chamber assembly, the opposite end portion having an enlarged end cap forming a second stop for the slide chamber assembly and a reduced external diameter area adjacent the enlarged end cap, venting aperature formed through the wall of said cylindrical body member about said reduced external diameter area for venting gases from the bore of said cylindrical body member, said slide chamber assembly having at least one gas vent. The compensator is associated with a breech bolt slide of a pistol and with a recoil spring of a pistol, whereby the slide assembly while in the forward position forms a secondary pressure chamber with the reduced diameter area to equalize forces on the base of a bullet in the cylindrical body member resulting from spent gases.

11 Claims, 3 Drawing Sheets

AUTOMATIC PISTOL BARREL AND RECOIL COMPENSATOR

FIELD OF THE INVENTION

The present invention relates to barrels with compensators and climb arresters, which are particularly adapted for use with slide type automatic pistols and rifles. More particularly, the invention is concerned with the combination of a barrel and recoil compensator for automatic pistols and rifles of the type that automatically extracts a spent cartridge from a firing chamber after a shot is fired, retracts the bolt, ejects the cartridge and present a fresh cartridge to the chamber.

BACKGROUND OF THE INVENTION

It is common knowledge that hand held firearms when fired create a reaction force which drives the firearm upwardly. Accordingly, when such firearms are fired, the reaction forces create a force moment couple tending to twist or rotate the gun so as to cause the muzzle to climb upwardly.

Various means and techniques have been employed by the prior art to overcome such upward movement. The prior art has generally provided compensators which are added onto the muzzle of a gun. These compensators add weight to the muzzle and are provided with vents to control gas expansion and direction.

The principle on which the prior art compensators are based is, by adding weight to the barrel, the heavier barrel delays locktime of the barrel and this in turn reduces recoil by absorbing energy while the barrel is still locked to the slide. The slide then recoils with less speed and with the added weight the felt recoil is thereby reduced.

Venting of the gases has been found to reduce muzzle flip. Compensators having an angled exhaust vector are believed to be more efficient in keeping the muzzle down and develop less turbulence around the exiting bullet than compensators that direct the gases in a 90 degree break around an abrupt flat-surfaced corner.

In modern action-shooting competition handguns, compensators are of four common types: simple ported barrels, weighted barrel extensions, deflection chambers, and expansion chambers. Their function is to reduce muzzle flip and thereby reduce recovery time for quicker follow-up shots. In most of the automatic pistol compensators there are two elements of operation. The added weight of the device being attached to the muzzle and the upward venting of gases through a hole or holes in the top surface of the device. The combined effect is to keep the muzzle down.

U.S. Pat. No. 2,935,000 discloses a combination torque and recoil compensator and barrel bushing for guns which diverts a portion of air and spent gases out through segmental slots.

U.S. Pat. No. 2,313,669 relates to compensators and climb arresters. Slots are provided to provide a prerelease of some gases prior to action by the climb arrester.

Some of the problems with the prior art devices are that the compensators available are intended for use with bullets of specific loads and weight. While these compensators may be suitable for competition shooting where the bullets are carefully constructed, accuracy is lost with non-competition guns such as utilized by the military and law enforcement agencies.

The prior art post muzzle compensators also create a turbulence in the gases that surround the bullet in its flight path. The turbulence varies with the different loads of the bullets.

SUMMARY OF THE INVENTION

According to the present invention there is provided a barrel and recoil compensator for use with slide-type automatic pistols. The barrel and recoil compensator comprises a tubular cylindrical body member having an internal bore for forming a gun barrel and an axially movable slide chamber assembly surrounding the cylindrical body member. The cylindrical body member has at one end portion, means for detachably securing the cylindrical body means to the pistol. There is a shoulder portion between the end portion and the opposite end forming a first stop means for the chamber slide assembly. The opposite end has an enlarged end cap which is preferably threaded on the end so as to act as an adjustment with regard to barrel size. The end cap acts as a further stop means for the slide chamber assembly. Adjacent the end cap is a reduced external diameter area which together with the slide assembly forms a secondary pressure chamber that equalizes forces resulting from spent gases on the base of a bullet.

Venting aperature means are formed through the walls of the cylindrical body member for venting spent gases from the bore. The slide chamber assembly is also provided with at least one gas venting means. Preferably, the gas venting means is in the form of a slot.

Advantageously, the slide chamber assembly is provided with means for a cooperative association with the breech bolt slide and the recoil spring of a pistol.

The end cap is preferably threaded onto the barrel so as to be capable of adapting the barrel to different types of pistols. Venting means may also be provided in the end cap to expedite the discharge of spent gases.

According to another embodiment of the invention there is provided a slide type pistol having a receiver, a breech bolt slide reciprocally mounted on the receiver, and a recoil spring in combination with the barrel and recoil compensator of the invention.

The objects and advantages of the present invention will become more apparent when reference is made to the following detailed description considered in conjunction with the accompanying drawings.

DETAILED DESCRIPTION OF THE PREFERRED EMBODIMENTS

Figure 1:
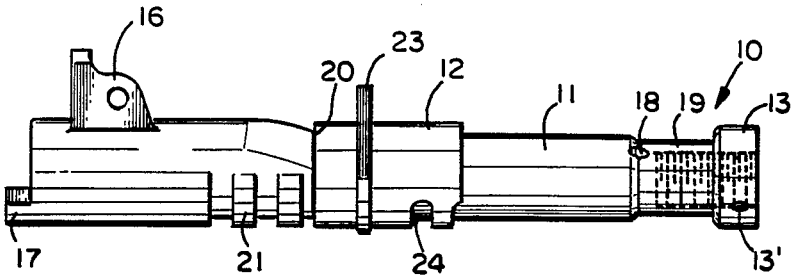
FIG. 1 is a side elevational view of the pistol barrel and recoil compensator of the invention.
Figure 2:
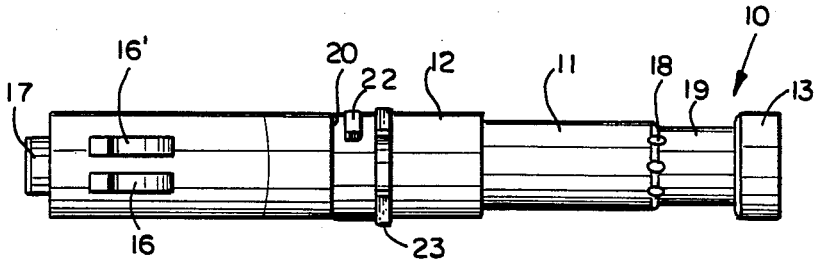
FIG. 2 is a bottom plan view of the pistol barrel and recoil compensator of FIG. 1.
Figure 3:
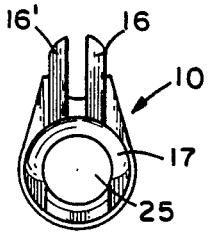
FIG. 3 is a rear elevational view of the barrel and recoil compensator of FIG. 1.
Figure 4:
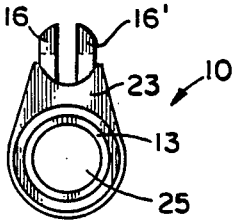
FIG. 4 is a front elevational view of the barrel and recoil compensator of FIG. 1.
Figure 5:
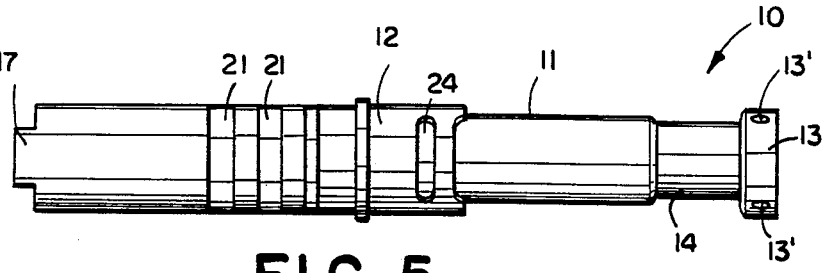
FIG. 5 is a top plan view of the barrel and recoil slide chamber compensator of FIG. 1.

As seen in FIGS. 1–5 of the drawings, the barrel and recoil compensator 10 of the invention comprises a barrel 11 with a bore 25 and an axially movable slide chamber assembly 12 surrounding the barrel 11.

At one end portion of the barrel 12, which is placed in a receiver of an automatic pistol, is a hood 17 and locking lugs 16 and 16' which lock the device into the receiver. The barrel 11 is also provided with barrel lugs 21 which are used in association with holding means in the breech bolt slide.

The receiver holding portion of the barrel 11 is enlarged and forms a stop 20 for the slide chamber assembly 12.

At the opposite end of the barrel 12 is an end cap 13 which forms a forward stop for the slide chamber assembly 12. The end cap 13 is advantageously threaded onto the end of the barrel 11 so as to provide an adjustment for barrel length and obtain a more secure fit in the event of variations in the breech bolt slide of a pistol in which it is used. The end cap 13 may be provided with a gas venting aperature 13 which permits escape of spent gases.

At a portion 19 adjacent the end cap 13 is a reduced diameter area which together with the slide chamber assembly 12 in the forward position forms a pressure chamber. The pressure chamber equalizes the forces at the base of the bullet while it is still in the barrel. As a result of the pressure chamber, any bullet weight, velocity or bullet design still obtains optimum muzzle suppression without a loss in accuracy. The gas chamber receives about 10 to 46% of the gas pressure, typically about 25%, when a round is fired.

Around the reduced diameter area 19 are gas venting aperatures 18 which extend through the barrel wall into the bore 25. The aperatures 18 may be in the form slits, slots, holes, or the like. Preferably, the aperatures 18 have a diameter of about 0.05 to 0.15 inches and comprise one to six ports.

Figure 6:
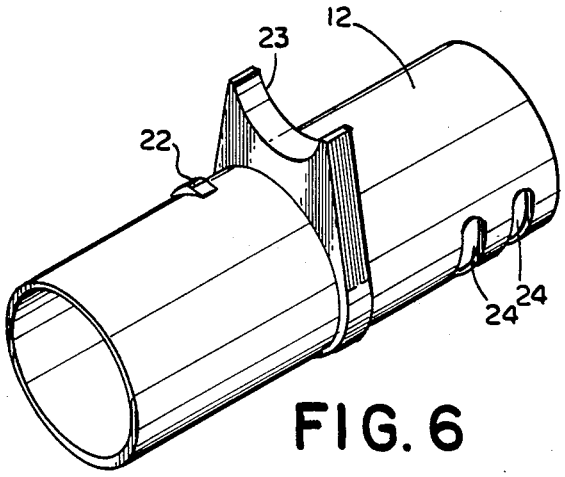
FIG. 6 is another form of the recoil compensator of the invention.

The slide chamber assembly 12 is provided with a locking lug 22 which locks into a breech bolt slide of a pistol so that the slide chamber assembly 12 moves with the breech bolt slide. An arcuate recess or recoil spring plug stop 23 is provided on the slide chamber assembly 12 which is operatively associated with a recoil spring of a pistol. The slide chamber assembly is provided with at least one gas venting slot 24 as shown in FIG. 1 or a plurality of slots 24 as shown in FIG. 6. The slide chamber assembly 12 in its most forward position extends completely over the reduced diameter portion 14 and covers aperatures 18.

Figure 7:
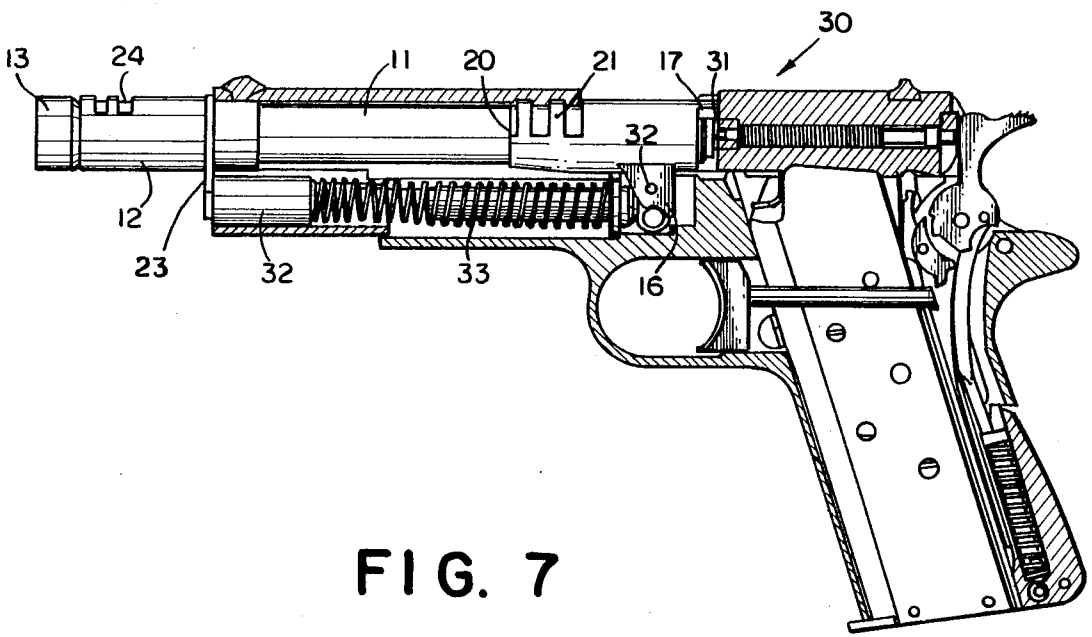
FIG. 7 is a side elevational view partly in section showing an automatic pistol equipped with the barrel and recoil compensator of FIG. 1.

In FIG. 7 the barrel and recoil compensator of the invention is shown as received in an automatic pistol 30. The barrel and recoil compensator is shown with the slide chamber assembly 12 of FIG. 6 in the forward position. At the rear the hood 17 is held in the slide lug groove 31 and lug links 16, 16' are locked into the barrel and receiver by a pin 32.

The recoil spring plug stop 23 is connected to the plug 32 of the recoil spring 33.

What is claimed is:

1. A barrel and recoil compensator for a slide-type automatic pistol comprising a tubular cylindrical body member having an internal bore for forming a gun barrel and an axially movable slide chamber assembly surrounding said cylindrical body member, said cylindrical body member having at one end portion means for detachably securing said cylindrical body means to said pistol, an opposite end portion and a shoulder portion therebetween, said shoulder portion forming a first stop means for said slide chamber assembly, said opposite end portion having an enlarged end cap forming a second stop means for said slide assembly and a reduced external diameter area adjacent said enlarged end cap, venting aperature means formed through the wall of said cylindrical body member about said reduced external diameter area for venting gases from the bore of said cylindrical body member, said slide assembly having at least one gas venting means, means for associating said compensator with a breech bolt slide of a pistol and means for associating said compensator with a recoil spring of a pistol, whereby the slide assembly while in the forward position forms a secondary pressure chamber with said reduced diameter area to equalize forces on the base of a bullet in the cylindrical body member resulting from spent gases.

2. The barrel and recoil compensator of claim 1 wherein said end cap is threadly mounted on said cylindrical body member for accomodating the barrel length.

3. The barrel and recoil compensator of claim 1 wherein said end cap has gas venting means.

4. The barrel and recoil compensator of claim 1 wherein said venting means comprises a plurality of holes around said cylindrical body member.

5. The barrel and recoil compensator of claim 1 wherein said slide chamber assembly has one slot for venting gases.

6. The barrel and recoil compensator of claim 1 wherein said slide chamber assembly has a plurality of slots for venting gases.

7. In a slide-type automatic pistol having receiver, a breech bolt slide reciprocally mounted on the receiver, a recoil spring, and a barrel, the improvement which comprises said barrel being associated with an axially movable slide chamber assembly surrounding said barrel, said barrel having at its middle portion, a first stop means for said slide chamber assembly, an enlarged cap at its forward end forming a second stop means for said slide chamber assembly and a reduced external diameter area adjacent said end cap, venting aperature means formed through the wall of said barrel about said reduced external diameter are for venting gases, said slide chamber assembly having at least one gas venting means, means for association with said breech bolt slide and means for association with said recoil spring, whereby when a bullet is fired, the slide chamber assembly forms a secondary pressure chamber with said reduced diameter area to equalize forces on the base of the bullet within the barrel resulting from spent gases.

8. The pistol of claim 7 wherein said end cap is threadly mounted for use with different barrel length.

9. The pistol of claim 7 wherein said end cap has gas venting means.

10. The pistol of claim 7 wherein said slide chamber assembly has one slot for venting gases.

11. The pistol of claim 7 wherein said slide chamber assembly has a plurality of slots for venting gases.

* * * * *